US007057329B2

(12) United States Patent
Barth et al.

(10) Patent No.: US 7,057,329 B2
(45) Date of Patent: Jun. 6, 2006

(54) COMPACT JACQUARD SELECTING CARD USING PIEZOELECTRIC ELEMENTS

(75) Inventors: Bernard Barth, Chatenois (FR); Herve Fesquet, Boersch (FR)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/945,031

(22) Filed: Sep. 20, 2004

(65) Prior Publication Data

US 2005/0122002 A1 Jun. 9, 2005

Related U.S. Application Data

(60) Provisional application No. 60/508,160, filed on Oct. 2, 2003.

(51) Int. Cl.
*H01L 41/00* (2006.01)
*D03C 3/20* (2006.01)

(52) U.S. Cl. ..... 310/323.17; 139/455

(58) Field of Classification Search ..... 310/323.17; 139/455

See application file for complete search history.

(56) References Cited

U.S. PATENT DOCUMENTS

| | | | | |
|---|---|---|---|---|
| 5,027,619 | A | 7/1991 | Saito | 66/218 |
| 5,392,818 | A | 2/1995 | Seiler et al. | 139/59 |
| 5,464,046 | A | 11/1995 | McIntyre et al. | 139/455 |
| 5,511,588 | A | 4/1996 | Jaksic | 139/455 |
| 5,647,403 | A | 7/1997 | Willbanks | 139/59 |
| 5,666,999 | A | 9/1997 | Dewispelaere et al. | 139/455 |
| 5,782,272 | A | 7/1998 | Dewispelaere et al. | 139/455 |
| 5,911,247 | A | 6/1999 | Waters | 139/455 |
| 6,041,831 | A | 3/2000 | Kuoni et al. | 139/55.1 |
| 6,073,662 | A | 6/2000 | Herbepin et al. | 139/455 |
| 6,216,750 | B1 | 4/2001 | Braun et al. | 139/455 |
| 6,327,120 | B1 | 12/2001 | Koganezawa et al. | 360/294.4 |
| 6,336,477 | B1 | 1/2002 | Kutzleb et al. | 139/455 |
| 6,371,170 | B1 | 4/2002 | Wardle | 139/455 |
| 6,470,919 | B1 | 10/2002 | Wardle | 139/455 |

FOREIGN PATENT DOCUMENTS

| | | | |
|---|---|---|---|
| DE | 3705738 | A1 * | 9/1988 |
| EP | 974692 | A2 * | 1/2000 |
| EP | 982419 | A2 * | 3/2000 |
| EP | 0 837 957 | | 9/2001 |
| GB | 2 276 637 | A | 10/1994 |
| JP | 11081104 | A * | 3/1999 |
| JP | 2001-348752 | | 12/2001 |
| JP | 2001348752 | A * | 12/2001 |
| JP | 2002105818 | A * | 4/2002 |
| JP | 2003-064551 | | 3/2003 |

* cited by examiner

*Primary Examiner*—Darren Schuberg
*Assistant Examiner*—J. Aguirrechea
(74) *Attorney, Agent, or Firm*—Frommer Lawrence & Haug LLP; Ronald R. Santucci

(57) ABSTRACT

A compact electronic selection card applicable for use in Jacquard equipment, having a high-density array of selecting hooks which are individually positioned by piezoelectric actuator elements. Each piezoelectric element directly controls a selecting hook for engaging a corresponding hooked rod connected to a warp yarn. The engaged rods are then lifted to form the shed. Because each element directly positions the hook rather than indirectly controlling a positioning mechanism, the selection card is mechanically simple and compact.

5 Claims, 3 Drawing Sheets

PIEZOELECTRIC

COMPACT JACQUARD SELECTING CARD USING PIEZOELECTRIC ELEMENTS

CROSS-REFERENCE TO RELATED APPLICATIONS

This application is based upon and claims the benefit of U.S. Provisional Patent Application Ser. No. 60/508,160 filed Oct. 2, 2003 entitled "COMPACT JACQUARD SELECTING CARD USING PIEZOELECTRIC ELEMENTS", the disclosure of which is incorporated herein by reference.

BACKGROUND OF THE INVENTION

1. Field of the Invention

The present invention relates to selecting cards for Jacquard-type equipment. More specifically, the present invention relates to a piezoelectric actuated selecting card for use in a Jacquard loom.

2. Description of the Prior Art

The use of Jacquard selection devices in weaving looms to produce intricate patterns by controlling the lifting of selected warp yarns is well known in the art. The separation formed between the lifted warp yarns and the non-lifted warp yarns is referred to as the shed. The Jacquard mechanism allows for independent movement of each warp yarn by controlling hooks (latches, catches) which engage matching hooks on rods (healds) connected to each warp yarn in a harness. A lifting device (or board) is used to raise or lower those warps in the harness whose corresponding hooks have been engaged. By coordinating the movement of the hooks, sequences of warp yarns can be selected and lifted while filling yarns are passed through the shed. In this manner, the Jacquard selection device is used to create the woven pattern.

Jacquard selection devices can be used in looms in either a closed shed or an open shed arrangement. In the closed shed arrangement, a single lifting device having an engaging hook for each warp in the harness is used. Whereas, the open shed configuration uses a double hook system of two lifting devices which provide pairs of engaging hooks which connect with pairs of (ascending and descending) rods that lift a single warp. The open shed configuration has two lifting devices and requires only a single move of each lifting device to create the shed, while the closed shed configuration has one lifting device but requires two moves.

Historically, the Jacquard mechanism involved a paper selection card having a pattern of punched holes. The selection card would allow those rods (or hooks) located at a hole to pass through and lift the corresponding warps, whereas the rods would be blocked at the locations without holes. By changing or shifting the selection card after each pass, the weave pattern could be formed.

This process was mechanically complex and often led to breakdowns and fabric quality problems. The mechanical complexity has been a major obstacle to increasing the efficiency of Jacquard machines. In response, several electrically selected loom latches have been proposed. For example, U.S. Pat. No. 6,073,662 to Herbepin, which is incorporated herein by reference, teaches the use of an electromagnetic device having a coil to control the position of each catch relative to a corresponding hook in a Jacquard selection device. When an electromagnet device is powered, the attached catch is positioned to engage the corresponding hook. The shed is opened by operation of a lifting board. Despite such proposed solutions, electrical and electromagnetic selection devices remain relatively large in comparison to the scale of the weave pattern.

A refinement of this electrical approach has been the application of piezoelectric elements to Jacquard selection devices. Piezoelectric actuator elements are devices that produce a lateral or longitudinal displacement with a high force capability when an operating voltage is applied. There are many applications where a piezoelectric actuator may be used, such as ultra-precise positioning and the generation/handling of high forces or pressures in static or dynamic situations.

Actuator configuration can vary greatly depending on application. For example, a flexure strip of piezoelectric material can be used to produce a transverse displacement. Piezoelectrics can also be stacked together to increase the displacement.

These devices are especially useful for controlling vibration, positioning applications and quick switching. For example, piezoelectric actuators can be designed to produce strokes of several micrometers at ultrasonic (>20 kHz) frequencies.

The critical specifications for piezoelectric actuators are the displacement, force and operating voltage of the actuator. Other factors to consider are stifffiess, resonant frequency and capacitance. Stiffness is a term used to describe the force needed to achieve a certain deformation of a structure. For piezoelectric actuators, it is the force needed to elongate the device by a certain amount.

Numerous approaches have been proposed to improve the operation of Jacquard-type weaving machines by incorporating piezoelectric elements. For example, U.S. Pat. No. 5,392,818 to Seiler discloses a needle selector for a Jacquard weaving machine similar to prior art mechanical devices only using piezoelectric transducers to adjust each blocking element. U.S. Pat. No. 6,470,919 to Wardle discloses an individual warp selector wherein a piezoelectric element drives a motor which mechanically moves a rigid heald. U.S. Pat. No. 5,464,046 to McIntyre discloses another individual warp selector wherein a piezoelectric element mechanically slides a warp selector in the longitudinal direction. U.S. Pat. No. 5,647,403 to Willbanks discloses using a piezoelectric element as a mechanical brake on the movement of a Jacquard warp selector. U.K. Patent No. GB 2 276 637 to Seiler and U.S. Pat. No. 5,666,999 to Dewispelaere disclose using piezoelectric elements as controls (locks) on the movement of catches for engaging lifting hooks in an open shed loom arrangement. However, each of these approaches simply uses the piezoelectric element to activate the mechanical elements which select the warp yarns. Because these approaches retain many of the complex mechanical features of the prior art, they exhibit many of the same limitations. For example, the size of these devices is not amenable to weaving high density patterns.

Therefore, a need exists for a Jacquard selection device which is mechanically reliable, operates at high-speed, has low power consumption, and is small enough to provide for high density warp selection.

The present invention provides a solution to the problem of providing a high density Jacquard selection device which is high-speed, reliable, and low power.

SUMMARY OF THE INVENTION

Accordingly, the present invention is an electronic selection card for a Jacquard machine which is high density, compact, and reliable.

The present invention is a selection device for a Jacquard machine. The device has a parallel array of evenly spaced piezoelectric actuated flexure elements which lie in a plane. Each flexure element in the array has a corresponding hook element connected to one end. A holding bar connects a second end of each flexure element in the array and lies in the plane. An axial rod parallel to the holding bar passes through an axis hole in each hook element, thereby providing a common axis for each hook element to pivot. Each hook element is independently positioned by actuating the piezoelectric in the corresponding flexure element, thereby causing the flexure element to bend out of the plane and forcing the connected hook element to pivot about the common axis.

Other aspects of the present invention include that the selection device may be an electronic selection card for a Jacquard loom used to weave fabric patterns. The hook elements may be used to select warp yarns from a harness for lifting to form a shed during weaving.

In a preferred embodiment, the array comprises twenty-four (24) piezoelectric actuated flexure elements and corresponding hook elements spaced within a length of less than 90 mm.

In another embodiment, each hook element comprises two opposing hooks.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The present invention is a compact selecting card for use in a Jacquard device; e.g. a loom. The selecting card comprises an array of selecting hooks which are individually positioned by piezoelectric actuators. Such a card provides many advantages over prior art electronic selection cards. For example, the present card exhibits improved operating speed and positional control, lower power consumption, and increased lifetime.

Figure 1:
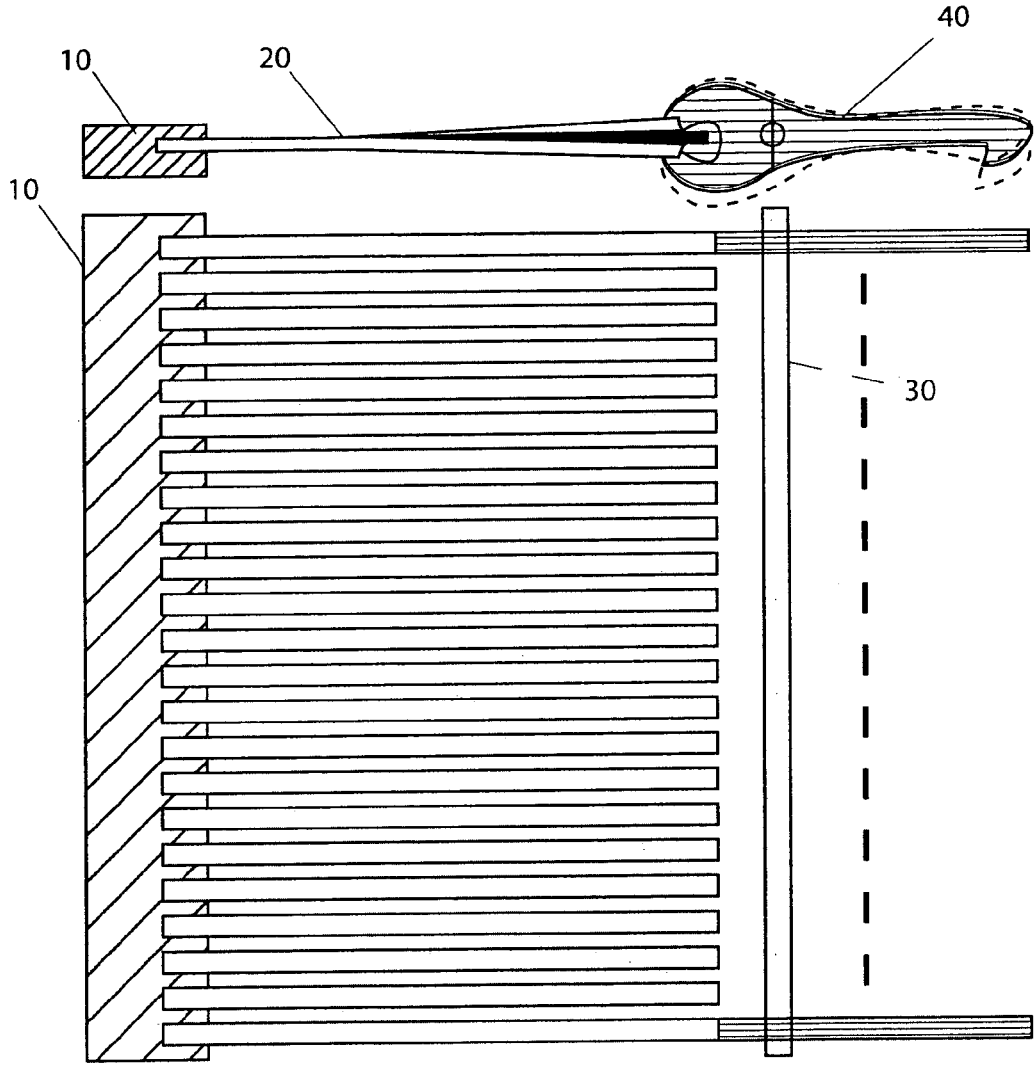
FIG. 1 is a front and side view of an exemplary compact selection card in accordance with the teachings of the present invention.

FIG. 1 is a front and side view of an exemplary compact selection card in accordance with the teachings of the present invention. The selection card has a parallel array of evenly spaced piezoelectric actuated flexure elements 20 which lie in a plane. Each flexure element in the array has a corresponding hook element 40 connected to one end. A holding bar 10 connects the other end of each flexure element 20 in the array and lies in the plane. An axial rod 30 parallel to the holding bar passes through an axis hole in each hook element 40, thereby providing a common axis for each hook element to pivot. The holding bar 10 and axial rod 30 combine to create a no-play assembly for the flexure elements 20. This allows the piezoelectric elements to supply all their force and control to the attached hooks 40. Each hook element 40 is independently positioned by actuating the piezoelectric in the corresponding flexure element 20, thereby causing the flexure element to bend out of the plane and forcing the connected hook element to pivot about the common axis.

The present selection device is suitable for use in a Jacquard loom used to weave fabric patterns. The hook elements may be used to select warp yarns from a harness for lifting to form a shed during weaving. This arrangement of flexure elements allows for a selection hook density such that each harness in a loom can be driven independent from one another.

In a preferred embodiment, the array comprises twenty-four (24) piezoelectric actuated flexure elements and corresponding hook elements spaced within a length of less than 90 mm. These hooks correspond to the yarns in a 24 warp yarn harness. This hook density is sufficient for each harness on a loom to be driven independently. For control of fewer than 24 yarns, the harness is simply not threaded for those yarns. Conversely, to control more than 24 yarns, multiple selection cards and harnesses can be used.

Figure 2:
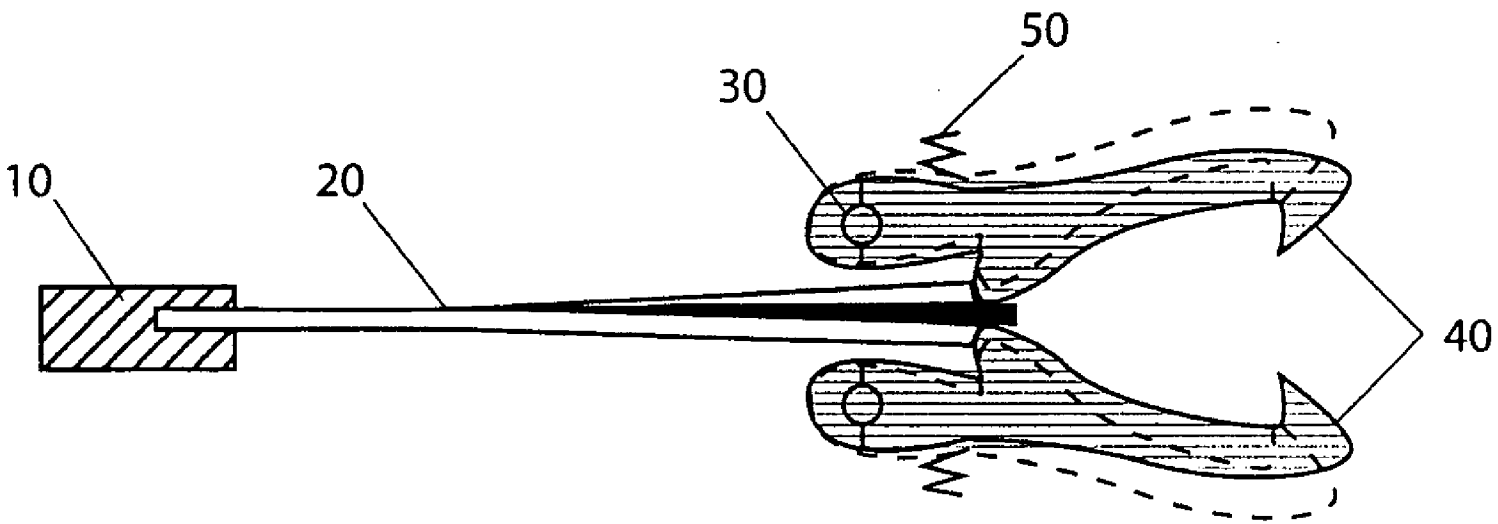
FIG. 2 is a side view of an exemplary double hook compact selection card in accordance with the teachings of the present invention.

FIG. 2 is a side view of another embodiment of the invention in which each hook element comprises two opposing hooks. As in the single hook embodiment, this double hook selection card has a parallel array of evenly spaced piezoelectric actuated flexure elements 20 which lie in a plane. A holding bar 10 connects one end of each flexure element 20 in the array and lies in the plane. Attached to the other end of each flexure element are a pair of hook elements 40. Axial rods 30 parallel to the holding bar pass through an axis hole in each hook of the double hook elements 40, thereby providing common axes for the hook elements to pivot. The holding bar 10 and axial rods 30 combine to create a no-play assembly for the flexure elements 20. This allows the piezoelectric elements to supply all their force and control to the attached hooks 40. Each pair of hooks are independently positioned by actuating the piezoelectric in the corresponding flexure element 20, thereby causing the flexure element to bend out of the plane and forcing the connected hook elements to pivot about the common axis. Because of the double hook configuration, a preloaded mechanism 50 such as a spring is needed to bias the hooks back into their neutral in plane position.

Both the single hook and double hook embodiments of the present selection card can be used in conjunction with various lifting devices in both closed shed and open shed configurations.

Figure 3A:
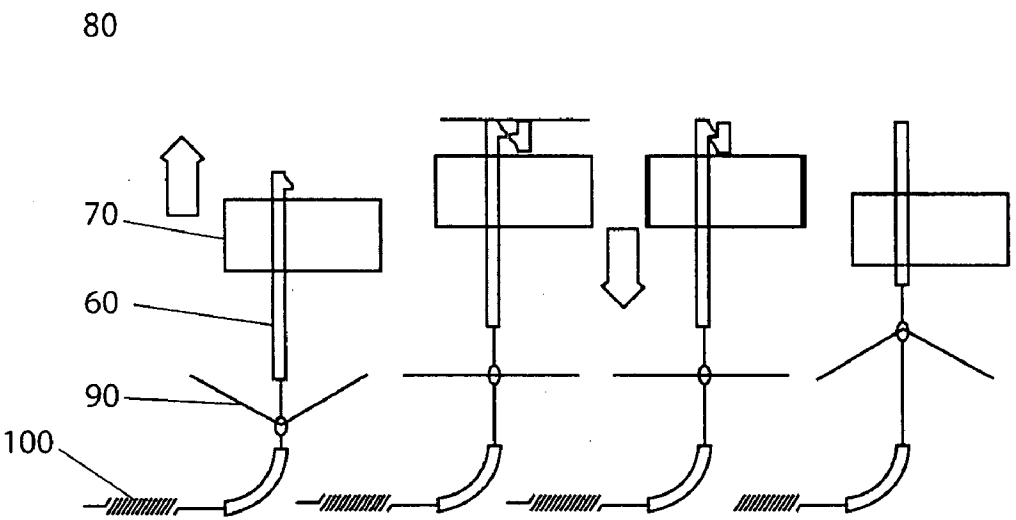
FIG. 3A (PRIOR ART)
FIG. 3 shows comparison views of the closed shed operating cycle for a prior art electric selection device and a piezoelectric selection device in accordance with the teachings of the present invention.
Figure 3B:
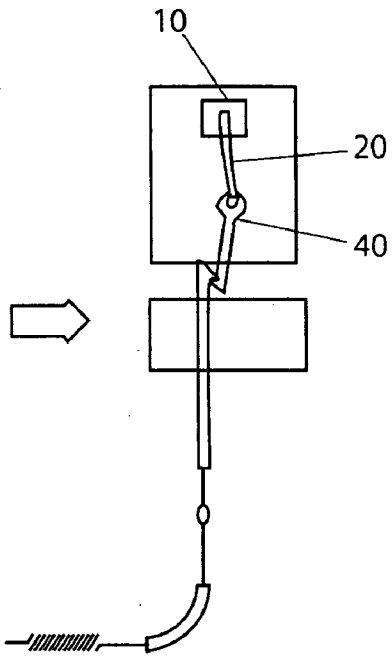

FIG. 3 shows comparison views of the operating cycle of a closed shed configuration for: 3A) a prior art electric selection device and 3B) a piezoelectric selection device in accordance with the teachings of the present invention.

The prior art electric devices in the closed shed configuration commonly use two plates moving in a 4 step cycle. Typically, the upper plate 80 acts as the lifting device and contains the selection device, while the lower plate positions the rods of the harness. In step S1, the upper plate 80 (or top lifting board) is in a raised position and the lower plate 70 is in a lowered position, thereby forming a wide separation between the plates. The upper plate hook element is not engaged with the hooked rod (or heald) 60. Note the shown upper plate hook corresponds to one of the hooks in a selection device while the hooked rod corresponds to one of the warps in the harness. The hooked rod passes through the lower plate and connects, typically through an eyelet, to a warp yarn 90. The hooked rod 60 is biased by a spring or weight 100 such that the rod and the connected warp yarn are pulled down as shown when the lower plate is in the lowered position and the hook is not engaged. This results in the connected yarn being in a lowered position. As shown in step S2, the plates are then moved towards each other. In this configuration, the upper plate is in a lowered position and the lower plate is in a raised position, thereby forming a narrow separation between the plates. By moving the lower plate from the lowered position to the raised position the hooked rod is also raised such that the connected yarn is in a flat or neutral position. In step S3, the upper plate hook is positioned by the electric mechanism to engage the hooked rod. Typically, the electrical mechanism is an electromagnetic coil which is activated to switch the hook between positions. The upper plate and lower plate are then moved apart in step S4 (to their respective positions in step S1). Because the upper plate hook is engaged with the hooked rod, when the upper plate moves to the raised position the hooked rod and connected yarn are pulled up as well. As shown, the connected yarn is pulled into a raised position above the neutral position. In this manner, each warp yarn in the harness can be controlled by engaging or not engaging its connected rod with the corresponding hook element in the selection device.

For the piezoelectric device shown in 3B, the electrical mechanism is replaced by the holding bar 10, flexure elements 20, and hooking elements 40 of the present selection card. This piezoelectric device similarly uses two plates moving in the same 4 step cycle as the prior art electric devices. For this type of design, the present selection cards are attached in position to the upper plate (top lifting board). The harness is positioned by the lower plate such that the rods in the harness can be engaged by the selection card hooks.

Another aspect of the invention is a feedback mechanism which can be integrated into the electrical control circuitry for the piezoelectric elements to determine the current position of the hook. In this manner, the proper functioning of each of the hook elements in the selection card can be actively monitored.

The present invention is applicable for use in many types of Jacquard equipment or any unit where binary positioning by mechanical components is required. As discussed herein, the present device may be used, in a Jacquard machine, to activate the position of each harness. In other applications, the device could be used to activate intermediary components linking each hook to parts that require setting in a binary position.

Modifications to the above would be obvious to those of ordinary skill in the art, but would not bring the invention so modified beyond the scope of the present invention. The claims to follow should be construed to cover such situations.

What is claimed is:

1. A selection device for a Jacquard machine, comprising:

a parallel array of evenly spaced piezoelectric actuated flexure elements lying in a plane;

each flexure element in the array having a corresponding hook element connected to a first end thereof;

a holding bar connecting a second end of each flexure element in the array and lying in said plane;

an axial rod parallel to said holding bar and passing through an axis hole in each hook element; thereby providing a common axis for each hook element to pivot; and wherein each hook element is independently positioned by actuating the piezoelectric in the corresponding flexure element, thereby causing the flexure element to bend out of the plane and forcing the connected hook element to pivot about the common axis.

2. The selection device according to claim 1, wherein the selection device is an electronic selection card for a Jacquard loom used to weave fabric patterns.

3. The selection device according to claim 1, wherein the array comprises twenty-four (24) piezoelectric actuated flexure elements and corresponding hook elements spaced within a length of less than 90 mm.

4. The selection device according to claim 1, wherein the hook elements are used to select warp yarns from a harness for lifting to form a shed during weaving.

5. The selection device according to claim 1, wherein each hook element comprises two opposing hooks.

* * * * *